US005743229A

United States Patent [19]

Hosoya

[11] Patent Number: 5,743,229

[45] Date of Patent: Apr. 28, 1998

[54] ENGINE ACCESSORY DRIVE

[75] Inventor: Takahisa Hosoya, Iwata, Japan

[73] Assignee: Yamaha Hatsudoki Kabushiki Kaisha, Shizuokoa-ken, Japan

[21] Appl. No.: 783,873

[22] Filed: Jan. 16, 1997

[30] Foreign Application Priority Data

Jan. 16, 1996 [JP] Japan ..... 8-004442

[51] Int. Cl.[6] ..... F02F 7/00

[52] U.S. Cl. ..... 123/195 A; 123/195 C

[58] Field of Search ..... 123/195 A, 195 C

[56] References Cited

U.S. PATENT DOCUMENTS

| | | | |
|---|---|---|---|
| 4,508,072 | 4/1985 | Takami et al. | 123/195 C |
| 5,022,365 | 6/1991 | Nariyama | 123/196 R |
| 5,063,897 | 11/1991 | Okui et al. | 123/195 A |
| 5,099,945 | 3/1992 | Okui et al. | 123/90.31 |
| 5,129,375 | 7/1992 | Takane et al. | 123/195 C |
| 5,231,961 | 8/1993 | Shimada et al. | 123/90.27 |
| 5,503,117 | 4/1996 | Saito | 123/195 C |

*Primary Examiner*—Noah P. Kamen

*Attorney, Agent, or Firm*—Knobbe, Martens, Olson & Bear LLP

[57] ABSTRACT

An engine having an accessory drive and mounting arrangement is disclosed. The engine has a camshaft drive comprising a drive pulley connected to an end of a crankshaft, and drive pulleys connected to the ends of each a intake and exhaust valve actuating camshaft. The crankshaft drives the camshafts via a timing belt engaging the drive pulleys. A mounting bracket is provided for connecting the engine to a frame member and for connecting one or more engine accessories to the engine. The mounting bracket is connected to the engine and includes a cover portion cooperating with a separate camshaft cover to enclose the camshaft drive pulleys and timing belt pathway.

16 Claims, 10 Drawing Sheets

ENGINE ACCESSORY DRIVE

FIELD OF THE INVENTION

The present invention relates to an engine accessory drive arrangement and mounting. In particular, the invention relates to an engine accessory mounting for an engine having an enclosed camshaft drive and a number of engine accessories.

BACKGROUND OF THE INVENTION

Internal combustion engines such as those utilized to power automobiles typically have an engine which is connected to a frame with a number of engine mounts. The engine is likely to include a number of engine accessories which are driven by the engine. For example, the engine may include an alternator for generating electricity, a power steering pump, an air conditioning compressor, and a water pump. In most instances, these engine accessories are driven with one or more drive belts which extend around a pulley mounted on an end of the crankshaft extending from the engine and a pulley mounted to a drive shaft of the accessory. In the instance where the accessories are driven by an external drive belt, the accessories are typically all positioned at one end of the engine. Each accessory is mounted to the engine by one or more accessory mounting brackets.

The engine may also include camshafts which open and close intake and exhaust valves controlling the flow of air and fuel into the combustion chambers of the engine and the flow of exhaust therefrom. These camshafts may be driven by an external timing belt off of the crankshaft. Damage to the timing belt may cause damage to the engine, especially in those engines in which the valves are of the interfering clearance type and would encounter the piston if the timing of the opening of the valve were gong. Thus, in order to protect the timing belt from damage, it may be positioned under a protective cover positioned at the same end of the engine as the accessories. This cover may also be used to route cooling air over the timing belt in order to keep it cool.

The use of a camshaft drive cover has the disadvantage that it forces the engine mount(s) and accessory mounting brackets to be positioned outside thereof. The mounting bracket(s) must be larger and stronger because then extend such a great distance outwardly of the engine and are subject to high loading. This increases the weight of the engine, and results in the engine having larger than desired dimensions.

An engine accessory drive and mounting arrangement for an engine having an external accessory drive and camshaft drive cover and which overcomes the above-stated problems, is desired.

SUMMARY OF THE INVENTION

An internal combustion engine having an accessory drive and mounting arrangement is disclosed. The engine is preferably of the type having at least one combustion chamber with an intake passage leading thereto and an exhaust passage leading therefrom. An intake camshaft controls an intake valve for controlling the flow of an air and fuel mixture into the combustion chamber, and an exhaust camshaft controls an exhaust valve for controlling the flow of exhaust from the chamber. A piston or other movable member is positioned in the combustion chamber and is connected to a crankshaft which is journalled for rotation with respect to the remainder of the engine and which has an end extending therefrom. The engine includes a camshaft drive system in the form of a timing belt driven by the crankshaft via a drive pulley connected to the end thereof, and a camshaft drive pulley connected to each camshaft.

A cover extends over at least a portion of the camshaft drive. Preferably, the cover comprises a main camshaft drive cover cooperating with a mounting bracket. The camshaft drive cover cooperates with the engine to define an enclosure within which the timing belt and camshaft drive pulleys are positioned. The main cover includes a cut-out area. The mounting bracket is connected to the engine and forms the portion of the cover not provided by the main cover at the cut-out area.

In the present arrangement, the camshaft drive is protected by a cover comprising the combined main cover and the mounting bracket. At the same time, however, because the mounting bracket is positioned in the cut-out area of the main cover, it is close to the engine and can be smaller mad of lighter weight than normal. In addition, the bracket does not extend beyond the engine in a manner which unduly increases the length of the engine.

The bracket preferably provides an external connection to the engine, such as for connection of a frame member or similar element to the engine or one or more engine accessories, such as an alternator. In a preferred embodiment, the bracket cooperates with a hanger for mounting the alternator near the front of the engine.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
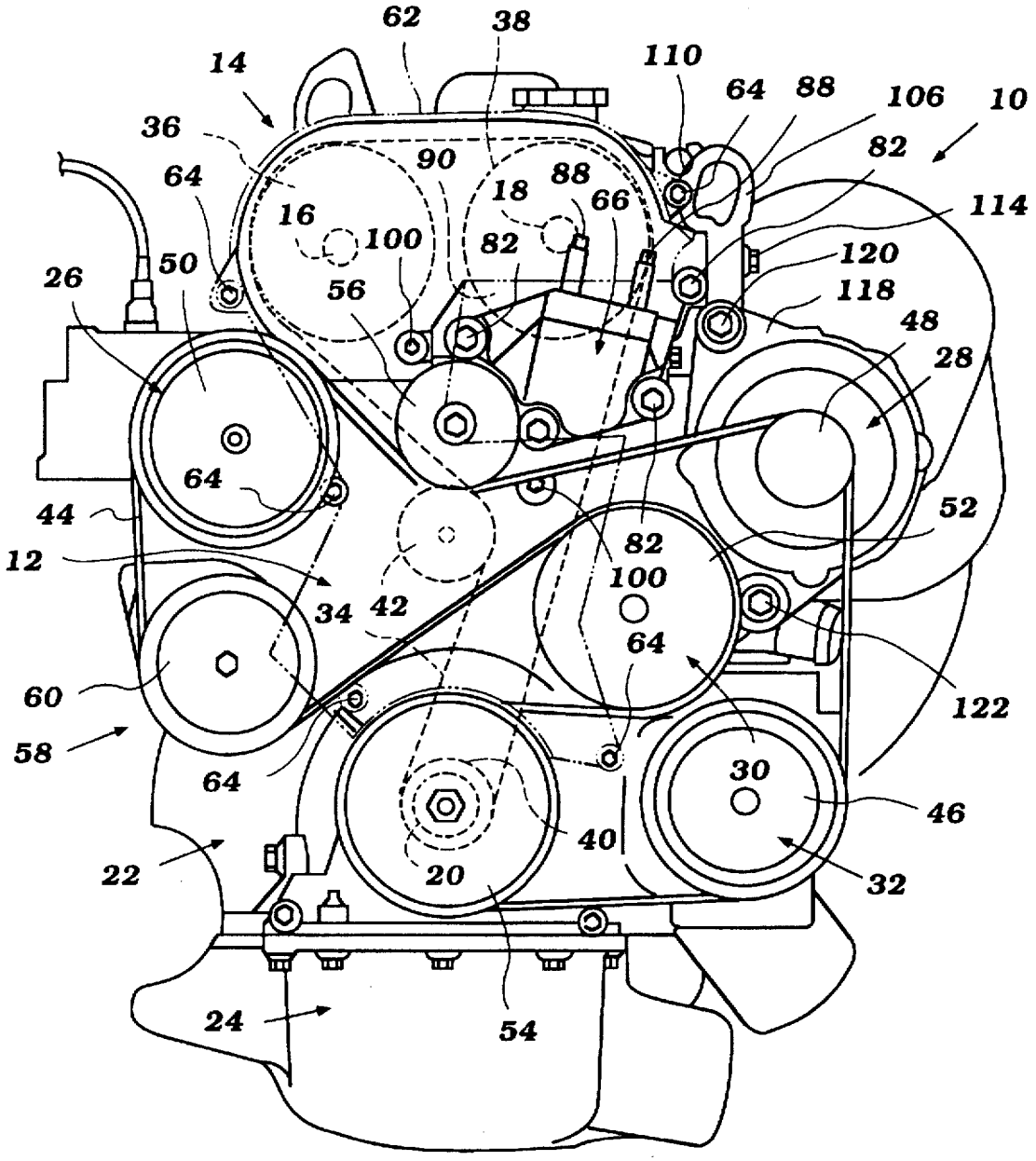
FIG. 1 is a from end view of an engine having an accessory drive in accordance with the present invention.

FIG. 1 illustrates an internal combustion engine 10 having a accessory drive and mounting arrangement in accordance with the present invention. In general, the cylinder block 12 comprises a cylinder block 12 having a cylinder head 14 connected thereto and defining therein at least one combustion chamber. The flow of an air and fuel mixture into each combustion chamber is preferably controlled by an intake valve which is actuated by an intake camshaft 16. Similarly, the flow of exhaust from each combustion chamber is preferably controlled by an exhaust valve which is actuated by an exhaust camshaft 18. A piston (not shown) is preferably reciprocally mounted within each combustion chamber and connected to a crankshaft 20. The crankshaft 20 is journalled for rotation within a crankcase portion 22 of the cylinder block 12 which is enclosed on the bottom by an oil pan 24.

As will be understood by one skilled in the art, the engine 10 may be of any of a variety of types, including inline, "V" or of a flat configuration. In addition, while there may be as few as one combustion chamber, there many be as many as 10 or more. Further, the engine 10 may be of the two or four-cycle variety. It is also noted that while the engine 10 is described as having separate intake and exhaust camshafts 16,18, the engine 10 may have only one combined camshaft.

As illustrated, the engine 10 preferably includes a number of engine accessories. In particular, the engine 10 includes a power steering pump 26, an alternator or generator 28, a water pump 30, and an air conditioning compressor 32. These engine accessories, along with the intake and exhaust camshafts 16,18 are preferably driven by one or more belts driven by the crankshaft 20.

Preferably, the camshafts 16,18 are driven by a first, timing drive belt 34. A drive pulley 36 is connected to a first end of the intake camshaft 16. A drive pulley 38 is also connected to a first end of the exhaust camshaft 18. These pulleys 36,38 are positioned outwardly of the cylinder head 14 at a front end of the engine. A drive pulley 40 is also positioned on the end of the crankshaft 20. The timing belt 34, which is of the flexible, toothed type, extends from the drive pulley 40 connected to the crankshaft 20 up and around a portion of the exhaust camshaft drive pulley 38, and then around a portion of the intake camshaft drive pulley 36. From there, the drive belt 34 extends back downwardly towards the crankshaft 20, engaging a tensioner pulley 42, before wrapping around the crankshaft pulley 40. In this manner, the crankshaft 20 rotates the camshafts 16,18, thereby controlling the intake and exhaust valves.

A second, accessory drive belt 44 drives the engine accessories. In particular, a drive pulley 46 is connected to a drive shaft of the air conditioning compressor 32. A drive pulley 48 is connected to a drive shaft of the alternator 28, as are similar drive pulleys 50,52 corresponding to the power steering pump 26 and water pump 30.

As illustrated in FIG. 1, the flexible drive belt 44 extends from an outer drive portion 54 of the crankshaft drive pulley 40 across to the air conditioning compressor drive pulley 46, up to the alternator drive pulley 48, and over to the power steering pump drive pulley 50. Preferably, the belt 44 engages an idler pulley 56 between the alternator 28 and power steering pump 26.

From the power steering pump drive pulley 50, the belt 44 extends downwardly around a tensioner 58 having a pulley 60 mounted thereto. The belt 44 then extends across to the water pump drive pulley 52, and around that pulley back to the crankshaft pulley 40. In this manner, the crankshaft 20 drives the air conditioning compressor 32, power steering pump 26, water pump 30 and alternator 28.

In order to protect the timing belt 34 and camshaft drive pulleys 36,38 from damage, a camshaft drive cover 62 extends over the pulleys 36,38 and belt 34. Preferably, the cover 62 is a steel or plastic plate-like member which has a front wall and outer edges extending inwardly therefrom in at least some areas towards the cylinder block 12 and head 14, whereby the cover 62 cooperates with the cylinder block and head to enclose the pulleys 36,38 and the portion of the belt 34 extending therearound (the cover 62 is illustrated in phantom lines in FIG. 1). As illustrated, the cover 62 is preferably connected to the cylinder block 12 and head 14 with a number of bolts 64.

In accordance with the present invention, there is provided an improved engine and accessory mounting arrangement. Preferably, as illustrated in FIG. 1, this arrangement is facilitated by a unique mounting bracket 66. In general, this bracket 66 cooperates with the cover 62 to form a unitary covering for the camshaft drive, is connected to the engine and provides an external connection to the engine for connection of a frame member or the mounting of one or more of the various engine accessories. Due to the configuration and mounting arrangement of the bracket 66, the bracket remains close to the engine and can be smaller and of lighter weight than normal.

The bracket 66 is best illustrated in FIGS. 4–10. As illustrated therein, the bracket 66 is somewhat "plate-like," and preferably constructed of cast metal. The bracket 66 has a front surface 70 which faces away from the engine 10 when mounted thereto, and a rear surface 72 which faces the engine. In addition, the bracket 66 generally has a top 74, bottom 76, a first side 78 and a second side 80.

Preferably, four mounting holes 68 extend through the bracket 66 from the front 70 to the rear 72. As best illustrated in FIG. 1, the holes 68 are sized for passage therethrough of suitable mounting bolts 82 for use in mounting the bracket to the engine 10. The front 70 also includes an outwardly extending section 84 for use in mounting the bracket 66 to a frame member, such as the frame of the automobile with which the engine is utilized. Preferably, three bores 86 are provided in a generally flat top surface of the outwardly extending section. As illustrated in FIG. 1, mounting means, preferably in the form of mounting bolts 88 engaging the bores 86, connect the bracket 66 to the frame, and thus the engine 10 to the frame.

Figure 2:
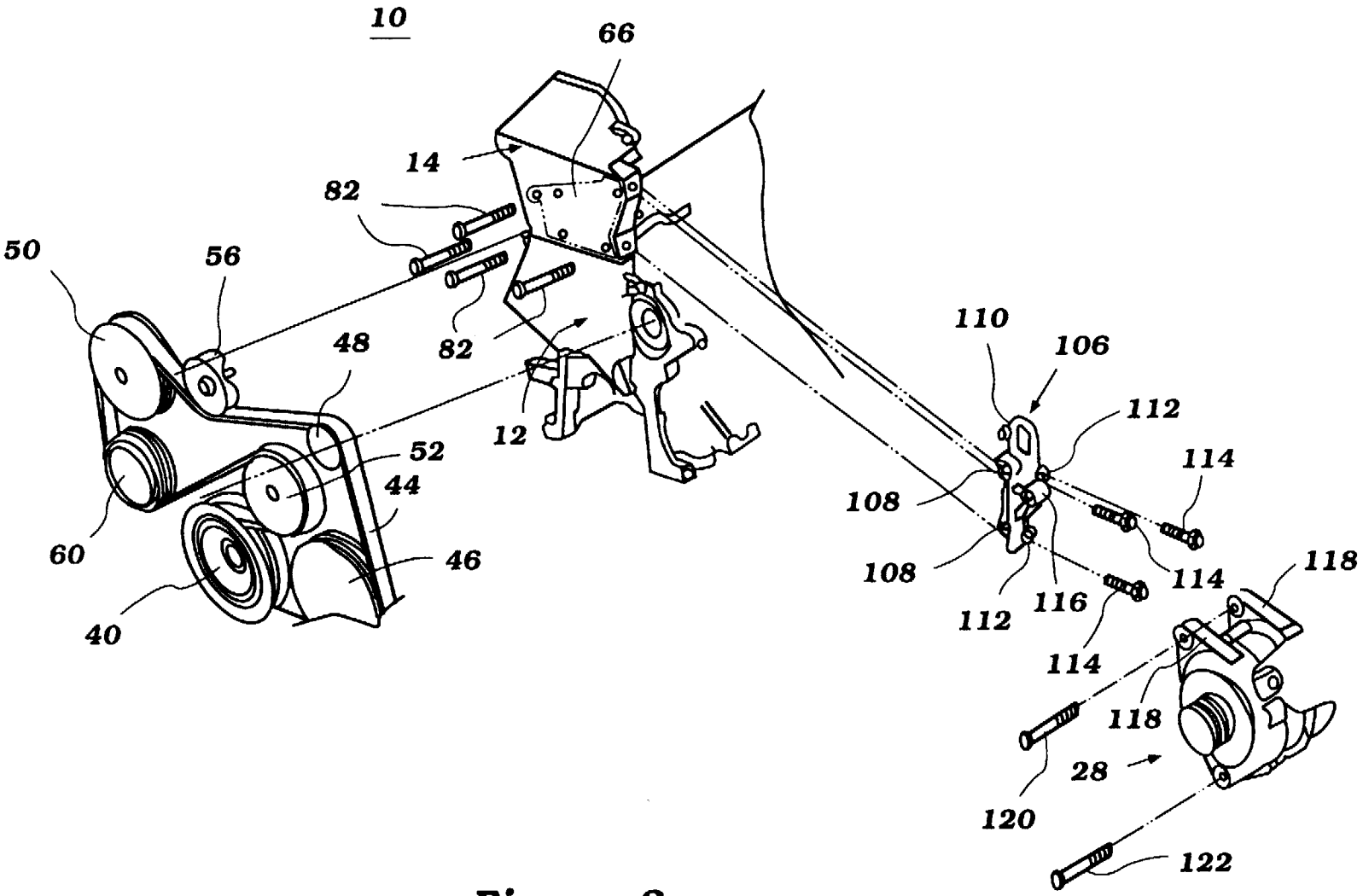
FIG. 2 is a partial exploded view of the engine illustrated in FIG. 1 illustrating a mounting bracket and accessory drive.
Figure 3:
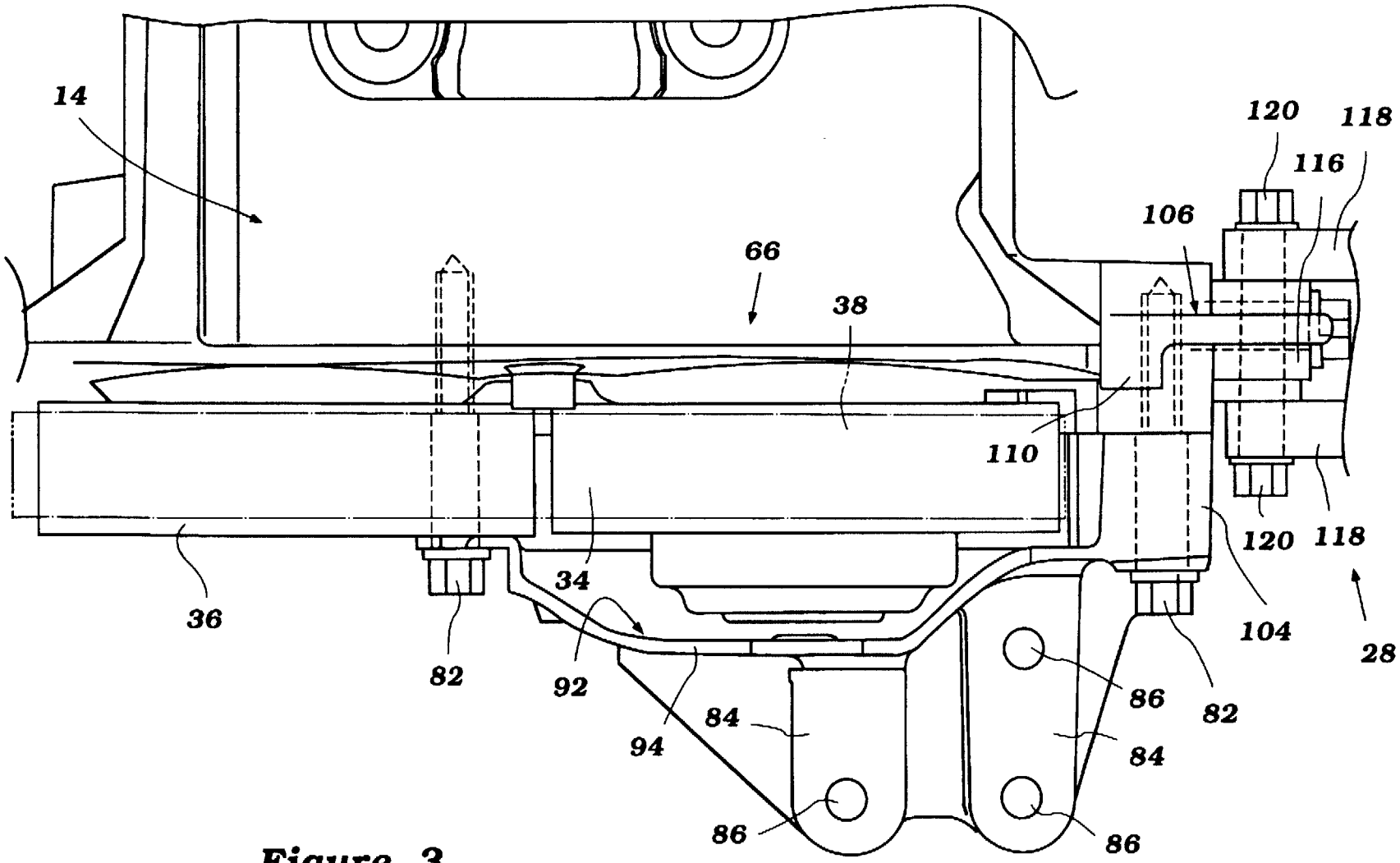
FIG. 3 is a top view illustrating the front end of the engine illustrated in FIG. 1 with a camshaft drive cover thereof removed.
Figure 4:
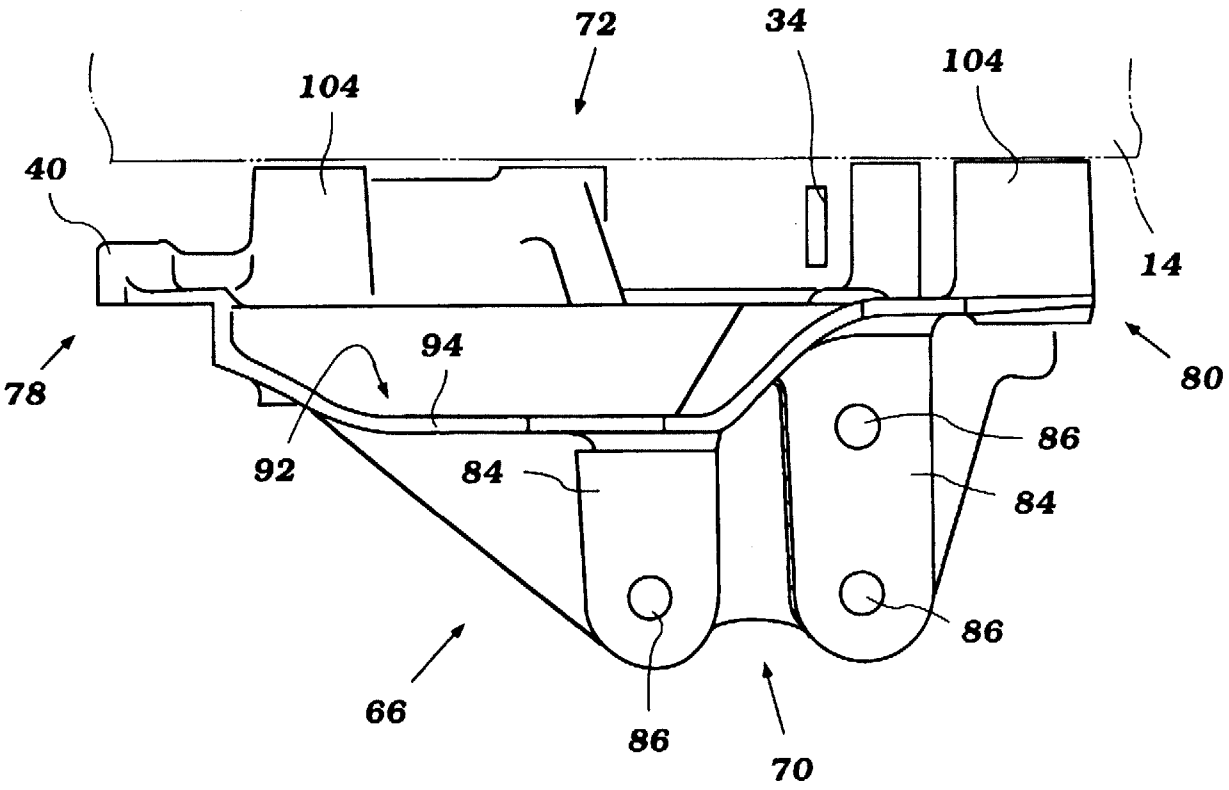
FIG. 4 is a top view of the mounting bracket in accordance with the present invention.
Figure 5:
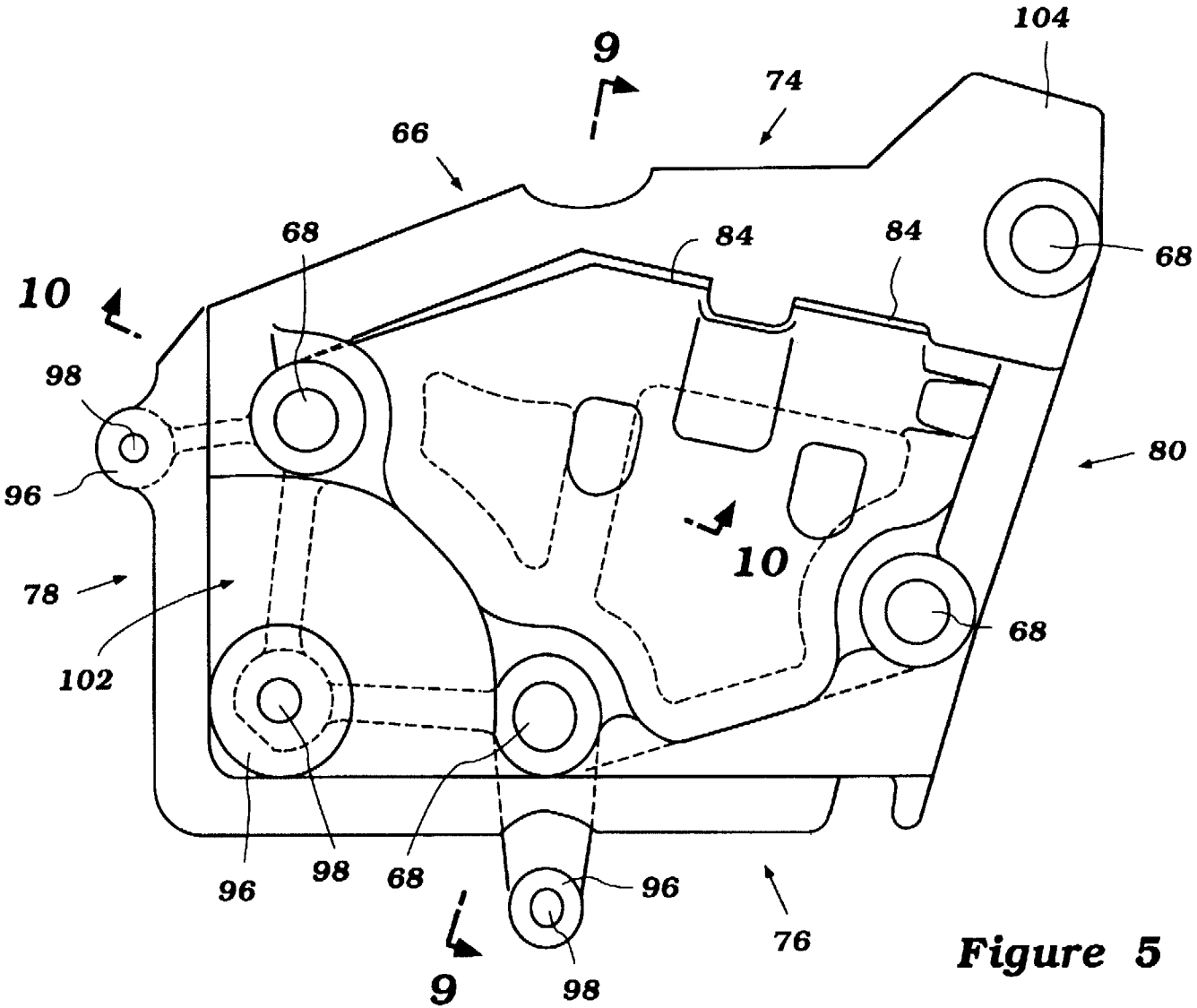
FIG. 5 is a front view of the mounting bracket.
Figure 6:
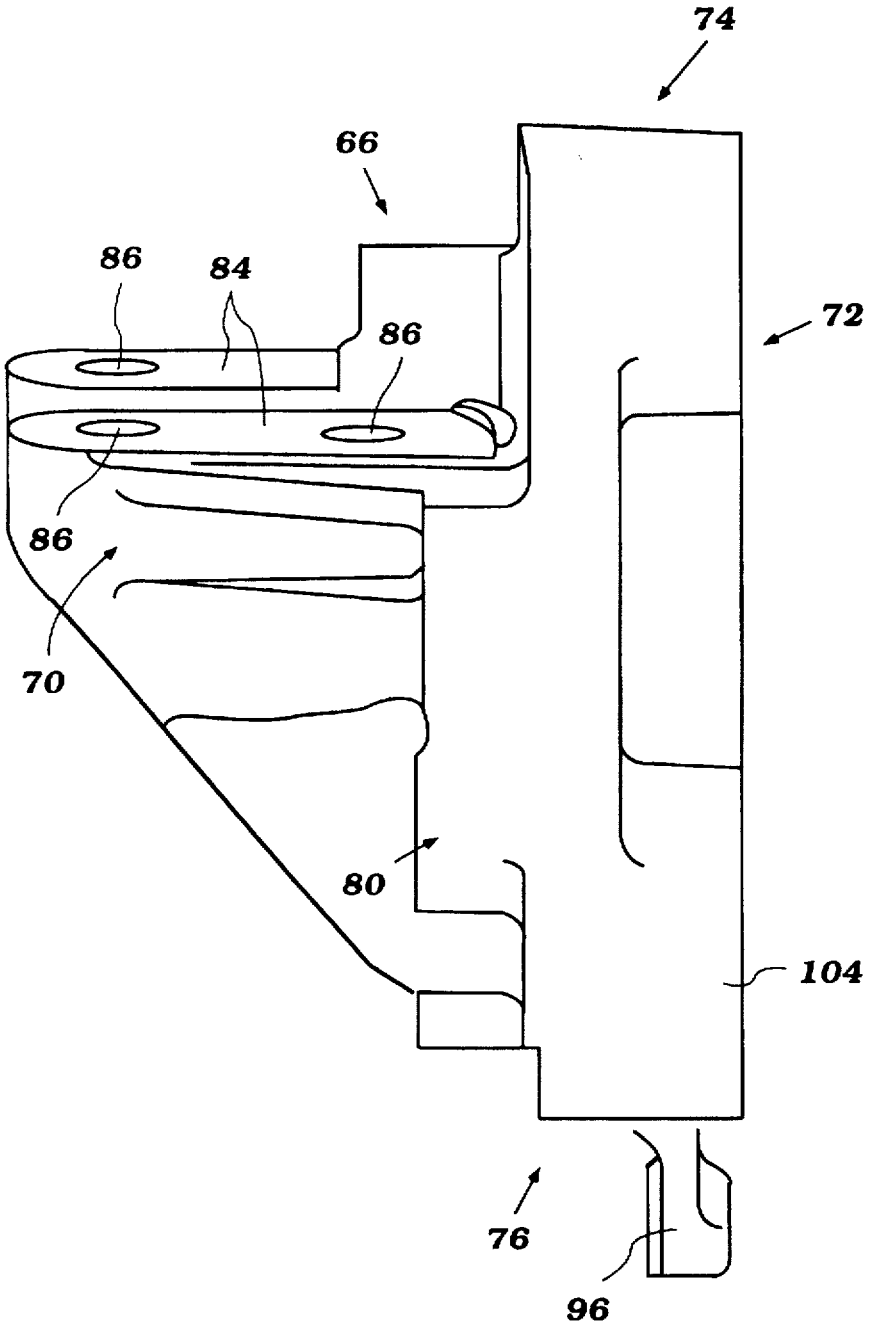
FIG. 6 is a first side view of the mounting bracket.
Figure 7:
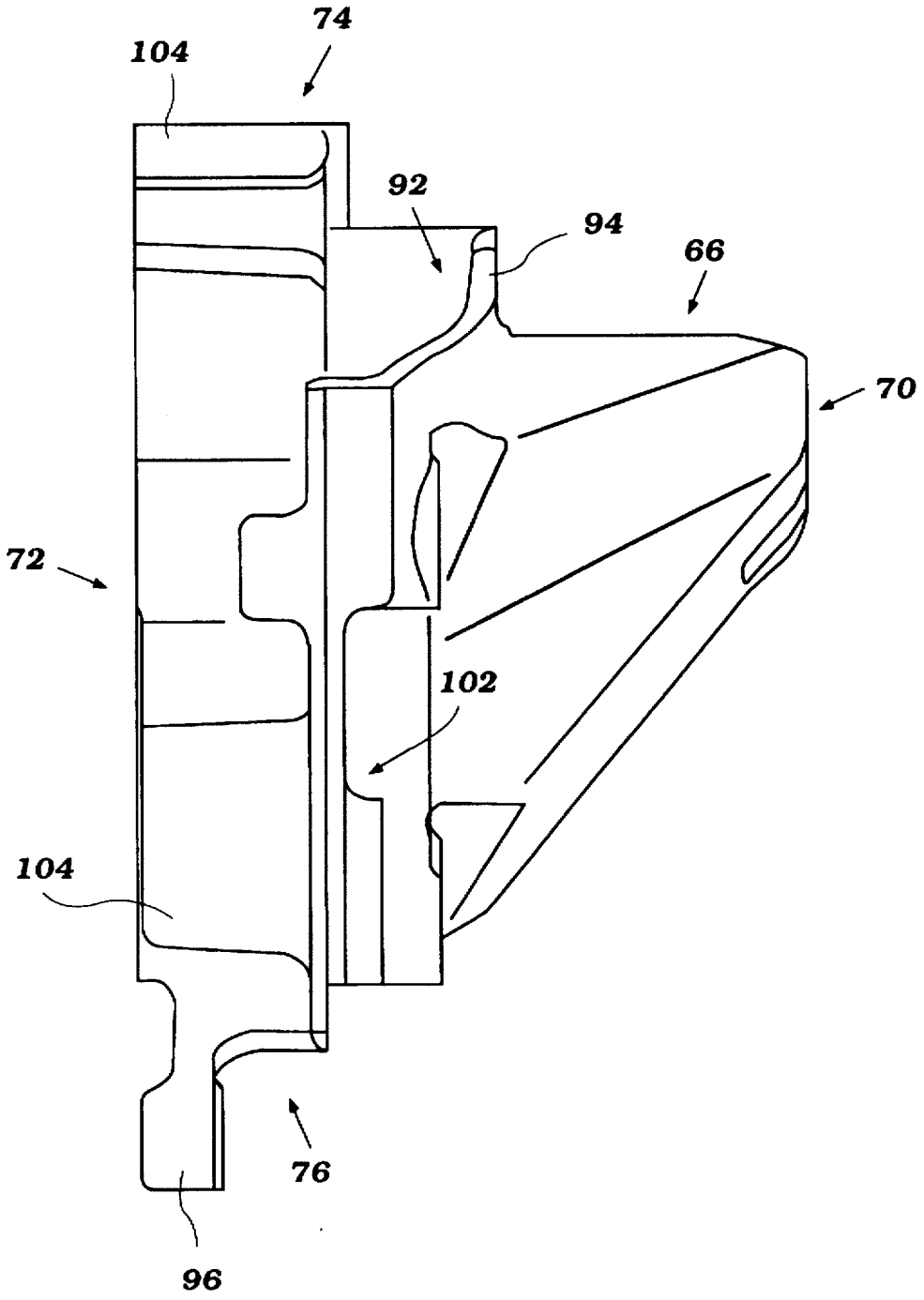
FIG. 7 is a second side view of the mounting bracket.
Figure 8:
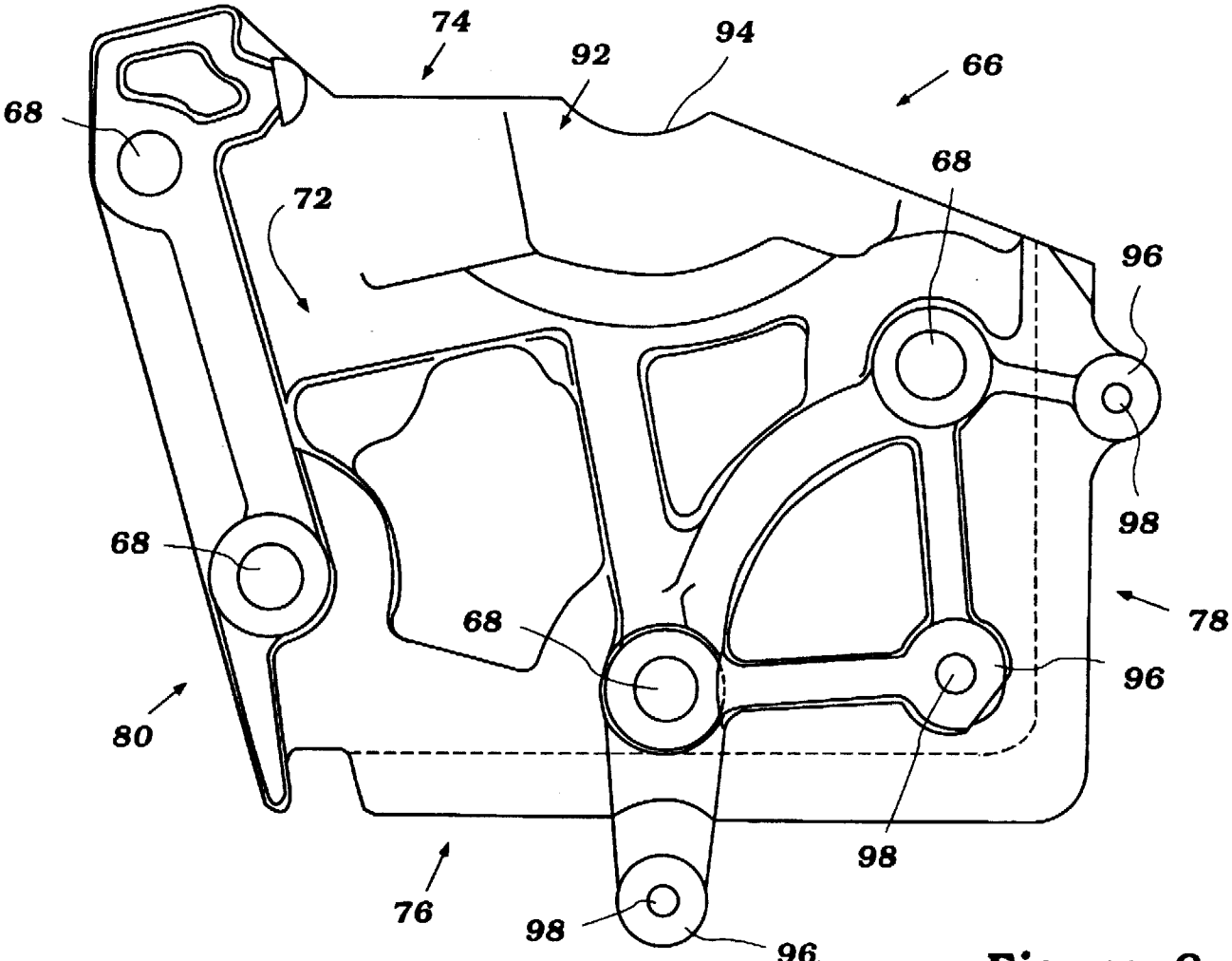
FIG. 8 is a rear view of the mounting bracket.
Figure 9:
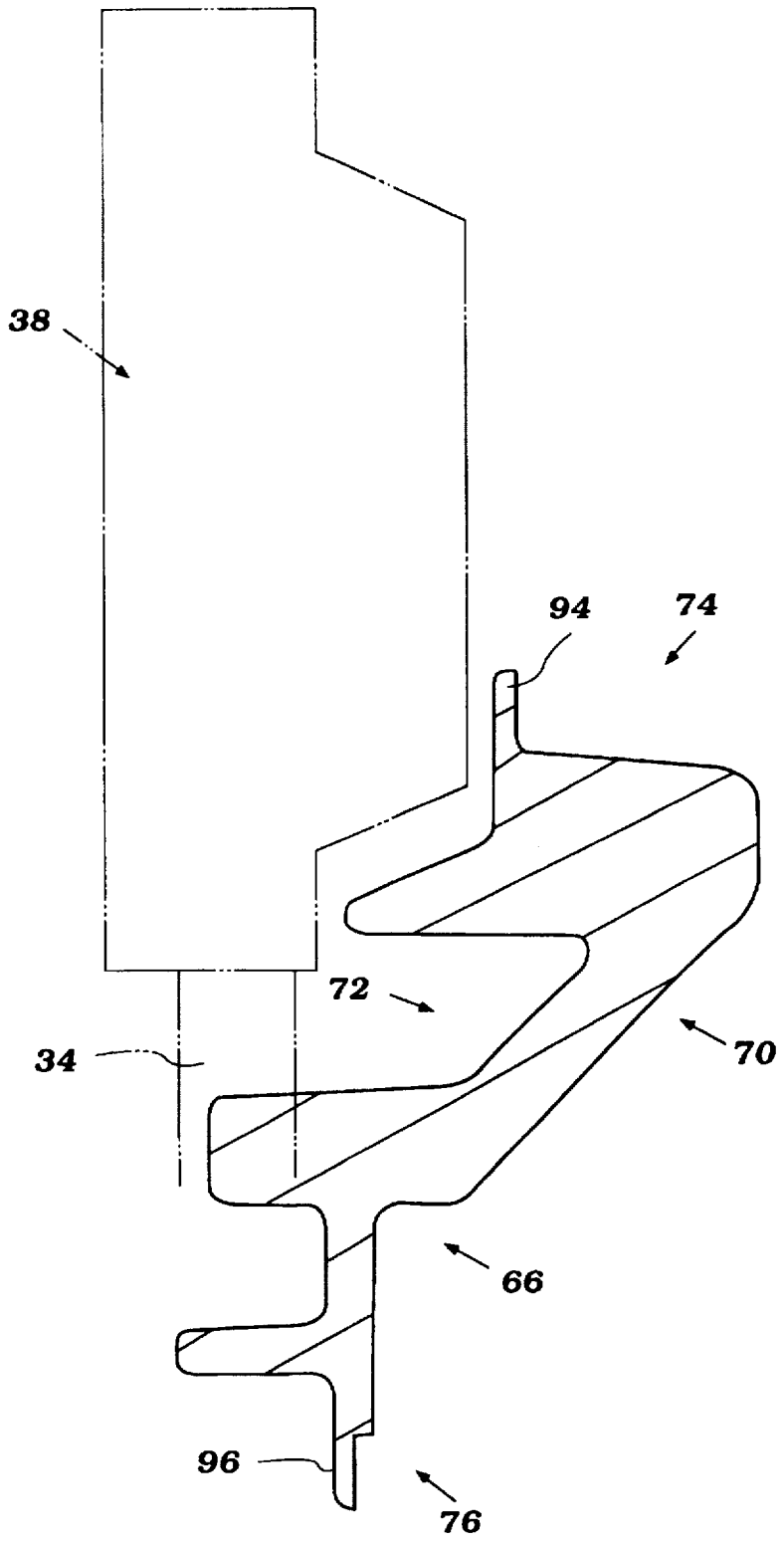
FIG. 9 is a cross-sectional side view of the mounting bracket illustrated in FIG. 5 and taken along line 9—9 therein.
Figure 10:
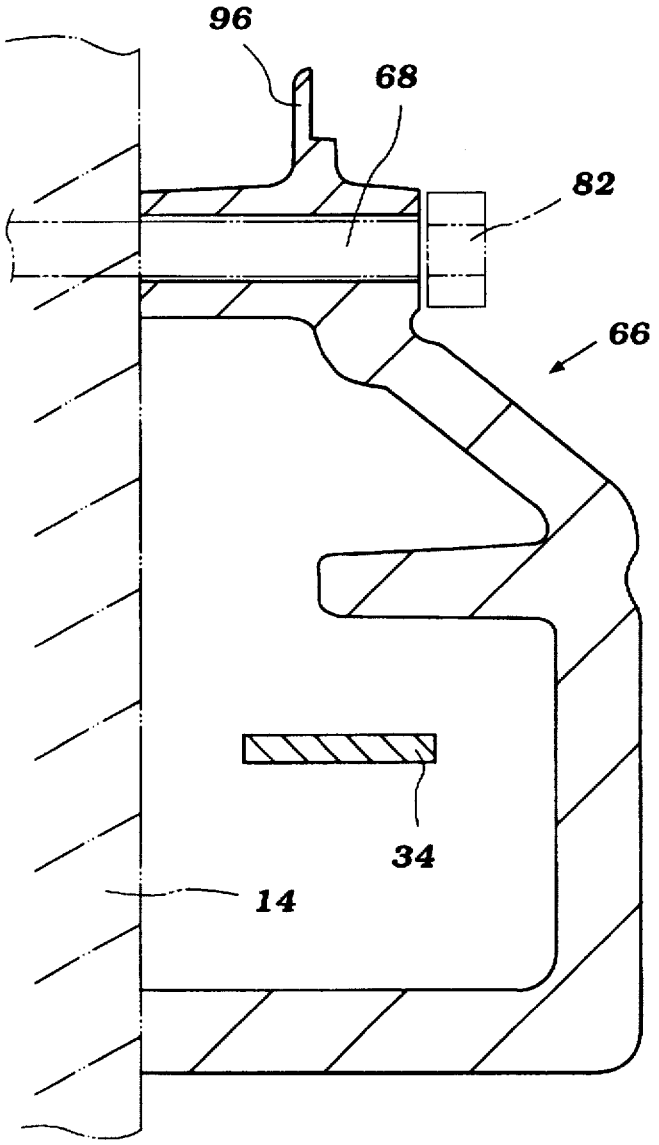
FIG. 10 is cross-sectional view of the mounting bracket illustrated in FIG. 5 and taken along line 10—10 therein.

Most preferably, the bracket 66 is arranged to cooperate with the cover 62 to form a contiguous cover over the camshaft drive. Preferably, the cover 62 includes a cut-away section 90 extending inwardly from an edge thereof. The bracket 66 includes a recessed or indented area 92 in the rear 72 thereof, with the top 74 having an edge 94 for abutment against the lower edge of the cover 62. As best illustrated in FIGS. 1 and 2, the recessed area 92 cooperates with the cover 62 to define an interior space within which the camshaft drive pulleys 36,38 and timing belt 34 are positioned. By "recessed area" it should be understood that the bracket 66 preferably has at least one portion which is positioned close to the engine, such as for mounting, and a "recessed" area or section thereof which is spaced some distance from the engine in order to accommodate the camshaft drive system.

The cover 62 is, in addition to being connected to the engine 10, connected to the bracket 66. In particular, the mounting bracket 66 includes three mounting areas 96 having passages 98 therethrough from the front 70 to the rear 72 for acceptance of cover mounting bolts 100.

As illustrated in FIG. 1, to facilitate proper positioning of the idler pulley 56, a recessed or depressed area 102 is formed in the front 70 of the bracket 70.

The bracket 66 includes a main mounting area 104 for the mounting of engine accessories. In the embodiment illustrated in FIGS. 1 and 2, a hanger 106 is connected to the main mounting area 104 for mounting the alternator 28 to the engine 10. As illustrated in FIG. 2, the hanger 106 has a first surface facing the bracket 66 and a second surface facing the alternator. The hanger 106 has a pair of bores 108 extending perpendicularly (to the outwardly facing surfaces) therethrough. These bores 108 so positioned that they align with the two bores 68 at the second side 80 of the bracket 66, so that the mounting bolts 82 not only engage the mounting bracket 66, but the hanger 106. In addition, the hanger 106 has a mounting area 110 having a passage therethrough in alignment with one of the bolts 64 which connects the cover 62 to the engine. The hanger 106 also contains three passage 112 extending perpendicular to the passages 108 and through the first to the second surface of the bracket, through which bolts 114 extend in engagement with the engine 10 (the cylinder head 14) for further connecting the hanger 106 to the engine.

In addition, the hanger 106 has an alternator mounting 116 in the form of a generally cylindrical extension having a bore therethrough. The alternator 28 has a pair of spaced mounting ears 118 for positioning at opposite ends of the mounting 116. A bolt 120 passing through a bore in each ear 118 and the bore in the mounting 116 connects the alternator 28 to the hanger 106. In addition, the alternator 28 is preferably connected to the engine's cylinder block 12 via another mounting ear positioned generally opposite the others, via a bolt 122.

In accordance with the engine accessory drive of the present invention, a cover is provided for enclosing the camshaft drive mechanism, the cover comprising the combined camshaft drive cover 62 and mounting bracket 66. Moreover, the mounting bracket 66 provides an external connection to the engine. In this fashion, the engine may be connected to a frame and/or one or more accessories. Advantageously, the mounting bracket 66 is positioned close to the engine, since it forms a portion of the camshaft drive enclosure. This allows the bracket 66 to be smaller and lightweight, and at the same time keeps the overall dimensions of the engine smaller.

While the engine 10 has been described above with a number of accessories, it should be understood that the engine may have any variety of accessories. For example, the engine 10 need not include an air conditioning compressor or power steering pump, and may include other engine accessories.

Of course, the foregoing description is that of preferred embodiments of the invention, and various changes and modifications may be made without departing from the spirit and scope of the invention, as defined by the appended claims.

What is claimed is:

1. An engine having an engine accessory drive, the engine having a cylinder block with a cylinder head connected thereto and cooperating therewith to define at least one combustion chamber, a piston mounted for reciprocation within said chamber and connected to a crankshaft, said crankshaft journalled for rotation with respect to said block and extending from an end thereof, an intake passage leading to said combustion chamber and an exhaust passage leading therefrom, intake valve means positioned in said intake passage for controlling the flow of the intake valve means, an exhaust camshaft for controlling the exhaust camshaft, a camshaft drive, the camshaft drive comprising a timing pulley mounted to said end of said crankshaft and a drive pulley mounted to each of said exhaust and intake camshafts, a timing belt engaging said drive pulleys, whereby said crankshaft drives said camshafts, a cover for cooperation with said cylinder block and head to partly enclose said camshaft drive, a mounting bracket for providing an external connection to said engine, said mounting bracket having a section thereof extending over at least a portion of said camshaft drive and cooperating with said cover to at least partly enclose said camshaft drive, said cover and mounting bracket connected to said engine.

2. The engine in accordance with claim 1, wherein said mounting bracket includes a mounting area for connecting said mounting bracket to a frame member, whereby said engine is connected indirectly to said frame member.

3. The engine in accordance with claim 1, wherein said mounting bracket has a front surface and a rear surface, and wherein said rear surface includes a recessed area therein for positioning therein of at least a portion of one of said drive pulleys connected to one of said camshafts.

4. The engine in accordance with claim 1, wherein said mounting bracket has at least one mounting portion for engagement by a mounting means for connecting said bracket to said engine.

5. The engine in accordance with claim 1, wherein said cover includes a cutout area and said mounting bracket is positioned within at least a portion of said cut-out area.

6. The engine in accordance with claim 1, further including a hanger connected to said mounting bracket and an engine accessory connected to said hanger.

7. The engine in accordance with claim 6, wherein said accessory is an alternator.

8. The engine in accordance with claim 1, wherein said engine includes a drive belt driven by said drive pulley connected to said crankshaft, said drive belt for driving at least one engine accessory, and including an idle pulley connected to said pulley for routing said drive belt, and wherein said mounting bracket includes a recessed area in a front surface thereof in which said idle pulley is at least partly positioned.

9. An engine accessory drive and mounting arrangement for an engine having a cylinder block with a cylinder head connected thereto, a crankshaft extending from said block and an end of at least one camshaft extending from said head, comprising a camshaft drive having a crankshaft drive pulley mounted to said end of said crankshaft and a camshaft drive pulley mounted to said end of said camshaft, a timing belt driven by said crankshaft drive pulley and driving said camshaft drive pulley, and a cover for covering at least a portion of aid camshaft drive, said cover comprising a main cover portion extending over at least a portion of said timing belt cooperating with a mounting bracket extending over at least a portion of said timing belt, said main cover portion and mounting bracket connected to said engine.

10. The engine accessory drive and mounting arrangement in accordance with claim 9, wherein said mounting bracket includes means for mounting said bracket to a frame member.

11. The engine accessory drive and mounting arrangement in accordance with claim 9, wherein another engine accessory is mounted at least in part to said mounting bracket.

12. The engine accessory drive and mounting arrangement in accordance with claim 11, wherein said accessory is an alternator.

13. The engine accessory drive and mounting arrangement in accordance with claim 12, wherein a hanger is attached to said mounting bracket and said alternator is attached to said hanger.

14. The engine accessory drive and mounting arrangement in accordance with claim 9, wherein said main cover portion has a cut-out area therein and said mounting bracket fits at least partially within said cut-out area.

15. The engine accessory drive and mounting arrangement in accordance with claim 9, wherein said bracket has a rear surface facing said belt and a front surface facing away from said belt, and wherein said front surface includes a pulley mounting area.

16. The engine accessory drive and mounting arrangement in accordance with claim 15, wherein said mounting area comprises a recessed section of said front surface.

* * * * *